US010746487B2

(12) United States Patent
Bian

(10) Patent No.: US 10,746,487 B2
(45) Date of Patent: Aug. 18, 2020

(54) DEVICE FOR LOADING BULLETS INTO FIREARM MAGAZINE

(71) Applicant: Ningbo Rotchi Business Co., Ltd., Ningbo (CN)

(72) Inventor: Yangchun Bian, Ningbo (CN)

(73) Assignee: NINGBO ROTCHI BUSINESS CO., LTD., Ningbo (CN)

( * ) Notice: Subject to any disclaimer, the term of this patent is extended or adjusted under 35 U.S.C. 154(b) by 0 days.

(21) Appl. No.: 16/411,117

(22) Filed: May 13, 2019

(65) Prior Publication Data

US 2020/0182570 A1 Jun. 11, 2020

(30) Foreign Application Priority Data

Dec. 7, 2018 (CN) ..... 2018 1 1496034

(51) Int. Cl.
*F41A 9/83* (2006.01)

(52) U.S. Cl.
CPC ..... *F41A 9/83* (2013.01)

(58) Field of Classification Search
CPC ..... F41A 9/83; F41A 9/86; F41A 9/87; F41A 9/82
USPC ..... 42/87
See application file for complete search history.

(56) References Cited

U.S. PATENT DOCUMENTS 4,574,511 A * 3/1986 Csongor ..... F41A 9/84 42/87
4,949,495 A * 8/1990 Mari ..... F41A 9/83 42/87
9,574,836 B1 * 2/2017 Cauley, Jr. ..... F41A 9/83
9,772,152 B1 * 9/2017 Niccum ..... F41A 9/83
10,132,582 B1 * 11/2018 Zhou ..... F41A 9/83
2013/0067788 A1 * 3/2013 Gray ..... F41A 9/84 42/88
2014/0033592 A1 * 2/2014 Fiorucci ..... F41A 9/83 42/87
2014/0223792 A1 * 8/2014 Socivoi ..... F41A 9/82 42/50
2014/0317985 A1 * 10/2014 Cauley, Jr. ..... F41A 9/83 42/87
2015/0377573 A1 * 12/2015 Niccum ..... F41A 9/83 42/87

(Continued)

FOREIGN PATENT DOCUMENTS

GB 379179 A * 8/1932 ..... F41A 9/83

*Primary Examiner* — John Cooper
(74) *Attorney, Agent, or Firm* — Matthias Scholl P.C.; Matthias Scholl

(57) ABSTRACT

A device for loading bullets into a firearm magazine, the device including a shell, a pushrod, and a top cover. The shell includes an outer wall and an inner chamber formed by the outer wall. The outer wall includes a first end including a first opening adapted to communicate with a magazine of a firearm, a second end including a second opening, and a third opening disposed between the first end and the second end and adapted to receive bullets. The pushrod includes a head, a main body, and a handle, and is connected to the second end of the shell and adapted to move in the inner chamber; when in use, the pushrod moves in the inner chamber to push the bullets to enter the magazine. The top cover is disposed on the outer wall and adapted to open and close the third opening.

20 Claims, 18 Drawing Sheets

(56) References Cited

U.S. PATENT DOCUMENTS

| | | | | |
|---|---|---|---|---|
| 2017/0067707 | A1* | 3/2017 | Zivic | F41A 9/83 |
| 2018/0292152 | A1* | 10/2018 | Wilkinson | F41A 9/83 |

* cited by examiner

DEVICE FOR LOADING BULLETS INTO FIREARM MAGAZINE

CROSS-REFERENCE TO RELATED APPLICATIONS

Pursuant to 35 U.S.C. § 119 and the Paris Convention Treaty, this application claims foreign priority to Chinese Patent Application No. 201811496034.9 filed Dec. 7, 2018, the contents of which, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to the field of bullet loading, and more particularly to a device for loading bullets into a firearm magazine.

Conventionally, the bullets are loaded into a magazine of a firearm one by one by hand. The loading process is time and labor consuming.

SUMMARY

The disclosure provides a device for loading bullets into a firearm magazine. The device is safe and efficient.

Disclosed is a device for loading bullets into a firearm magazine, the device comprising a shell, a pushrod, and a top cover. The shell comprises an outer wall and an inner chamber formed by the outer wall. The outer wall comprises a first end comprising a first opening adapted to communicate with a magazine of a firearm, a second end comprising a second opening, and a third opening disposed between the first end and the second end and adapted to receive bullets. The pushrod comprises a head, a main body, and a handle, and is connected to the second end of the shell and adapted to move in the inner chamber; when in use, the pushrod moves in the inner chamber to push the bullets to enter the magazine. The top cover is disposed on the outer wall and adapted to open and close the third opening.

The first opening, the second opening and the third opening communicate with the inner chamber; the second end of the shell is provided with a spring-loaded clip; the main body of the pushrod comprises a positioning groove and a reminding groove which correspond to the spring-loaded clip to position the pushrod in the inner chamber and indicate a bullet-loading number in the magazine, respectively.

The spring-loaded clip comprises a first cylinder, a first compression spring disposed in the first cylinder, and a locating pin connected to the first compression spring; the first cylinder comprises a limiting structure for preventing the locating pin from separating from the first cylinder. The first end is provided with at least two symmetrically-disposed spring-loaded clamps; the at least two symmetrically-disposed spring-loaded clamps each comprise a second cylinder, a second compression spring disposed in the second cylinder, and a metal ball attached to the second compression spring.

The first end can comprise first through holes for accommodating the at least two symmetrically-disposed spring-loaded clamps.

The first end can further comprise a locking device adapted to fix the magazine of the firearm; the locking device can comprise a first hinged shaft, a first locking block comprising an upper end and a lower end and being hinged to the outer wall of the first end via the first hinged shaft, a first lug connected to the lower end of the first locking block, and a first reset spring disposed on the outer wall of the first end and communicating with the upper end of the first locking block.

The second end can comprise a second through hole and the spring-loaded clip can be disposed in the second through hole; and the locating pin can be inserted in the positioning groove to position the pushrod in the inner chamber or in the reminding groove to indicate a bullet-loading number in the magazine.

The second end can comprise a first limiting structure; at least one side surface of the main body of the pushrod can be provided with a guide rail which corresponds to the first limiting structure to block the head of the pushrod from disengagement from the shell.

The first limiting structure can be a convex column, a pin, or a bolt.

The end area of the handle can be greater than a cross-sectional area of the main body.

The end face of the handle can be in the shape of a rectangle.

The end face of the handle can comprise a plurality of antiskid protrusions.

The cross-sectional shape of the shell can elliptical, and the outer wall of the shell can comprise a plurality of skidproof stripes close to the first end.

The outer wall of the second end of the shell can comprise at least two mutually symmetrical supports.

The top cover can be a semicircle in cross-section; suppose the third opening divides the outer wall of the shell as a first sidewall and a second sidewall, a first end of the semicircle can be fixed on the first sidewall of the shell through an elastic hinge, and the other end of the semicircle can be connected to an elastic locking assembly disposed on the second sidewall of the shell.

The elastic locking assembly can comprise a third hinged shaft, a third locking block hinged to the second sidewall via the third hinged shaft, a third reset spring disposed on the second sidewall and communicating with a lower end of the third locking block.

The third locking block can comprise a hook end, and the semicircle can comprise a catch end corresponding to the hook end.

The elastic locking assembly further can comprise a locking switch disposed in the third locking block.

The locking switch can comprise a U-shaped protective block and a lifting block; the U-shaped protective block can comprise a third through hole; the lifting block can comprise an extension rod; and the extension rod can be inserted in the third through hole.

The top cover can be transparent.

The shell can comprise a lifting lug.

Figure 1:
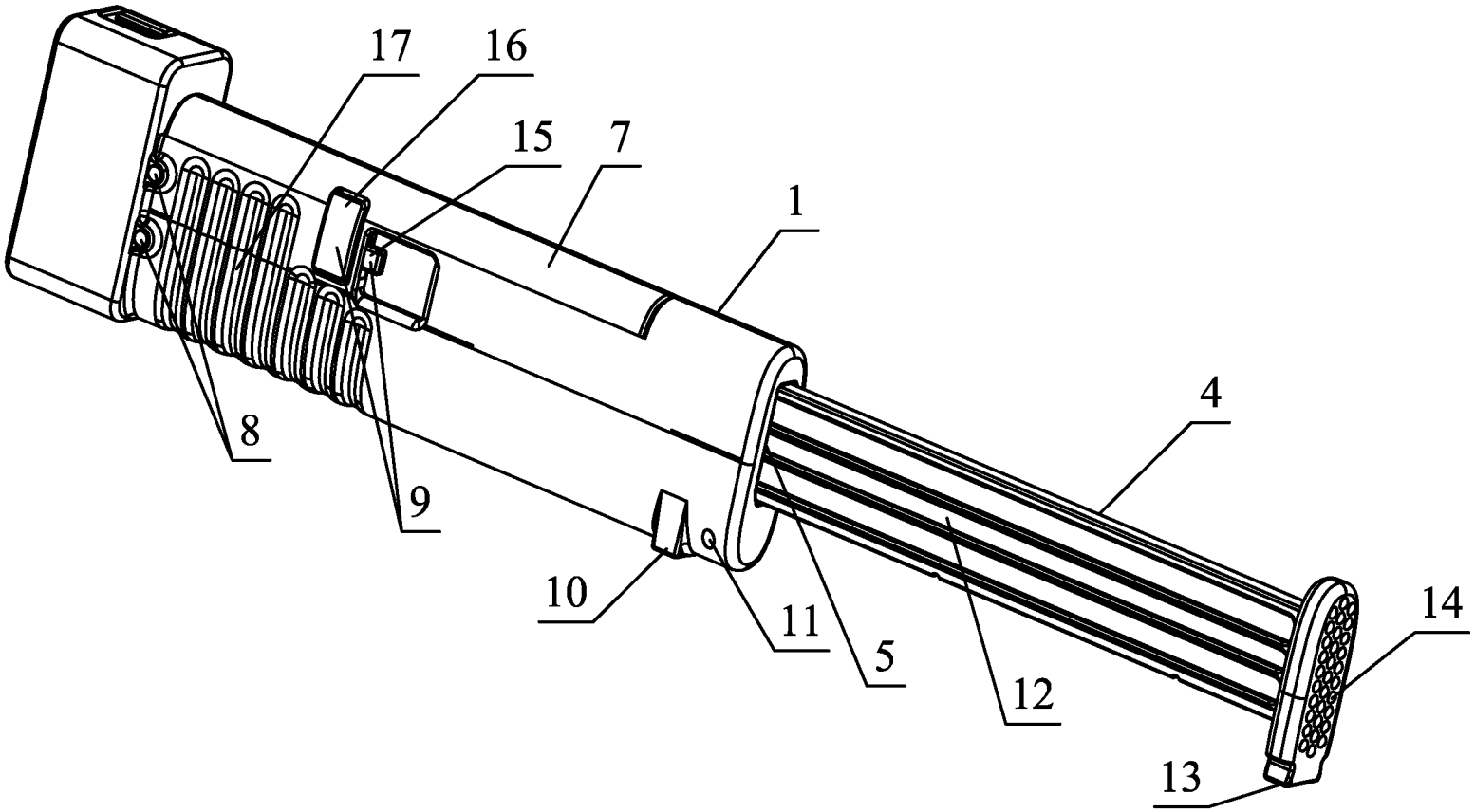
FIG. 1 is a stereogram of a device for loading bullets into a firearm magazine (a magazine of a rifle) according to the disclosure.

In the drawings, the following reference numbers are used: 1: shell; 2: inner chamber; 3: first opening adapted to communicate with a magazine; 4: pushrod; 5: second opening adapted to receive the pushrod; 6: third opening adapted to receive bullets; 7: top cover; 8: spring-loaded clamp; 9: elastic locking assembly; 10: support; 11: through hole; 12: guide rail; 13: right-angled corner; 14: antiskid protrusion; 15: lifting block; 16: third locking block; 17: skidproof stripe; 18: positioning groove; 19: reminding groove; 20: locking device; 21: elastic hinge; 22: hook and catch ends; 23: first locking block; 24: first hinged shaft; 25: first reset spring; 26: first lug; 27: handle; 28: main body; 29: fourth locking block; 30: first through hole; 31: metal ball; 32: second cylinder; 33: second compression spring; 34: limiting pin; 35: second through hole; 36: spring-loaded clip; 37: first cylinder; 38: first compression spring; 39: locating pin; 40: head; 41: U-shaped protective block; 42: third hinged shaft; 43: third reset spring; 44: second locking block; 45: second hinged shaft; 46: second reset spring; 47: second lug; 48: extension rod; 49: third through hole; 50: radial convex ring.

DETAILED DESCRIPTION

To further illustrate, embodiments detailing a device for loading bullets into a firearm magazine are described below. It should be noted that the following embodiments are intended to describe and not to limit the disclosure.

As shown in FIGS. 1, 2, 3 and 4, the disclosure provides a device for loading bullets into a firearm magazine. The device is also referred to as a quick bullet-loading tool, a quick bullet loader or the like. The device comprises a shell 1 which may also be referred to as a housing, a pushrod 4, and a top cover 7. The shell comprises an outer wall and an inner chamber 2 formed by the outer wall. The outer wall comprises a first end comprising a first opening 3 adapted to communicate with a magazine of a firearm, a second end comprising a second opening 5, and a third opening 6 disposed between the first end and the second end and adapted to receive bullets. The pushrod 4 comprises a head 40, a main body 28, and a handle 27, and is connected to the second end of the shell 1 and adapted to move in the inner chamber 2; when in use, the pushrod 4 moves in the inner chamber 2 to push the bullets to enter the magazine. The top cover 7 is disposed on the outer wall and adapted to open and close the third opening 6. The first opening 3, the second opening 5 and the third opening 6 communicate with the inner chamber 2.

The cross-sectional shape of the shell 1 is preferably elliptical, which can be interpreted as an elliptical shape comprising the inner chamber 2. Skidproof stripes 17 are provided on the handheld portion of the shell, close to the first end. For example, the skidproof stripes 17 comprising a plurality of annular grooves are provided on the outer wall along the rim of the elliptical shell 1 except for the top cover 7. The design helps tightly holding the device. Supports 10 arranged symmetrically and used for stably holding the shell 1 are provided on two side walls of the bottom of the shell 1 close to the second end. Accordingly, the shell can be firmly supported during the bullet loading process, and it is more convenient for the sliding of the pushrod. The bottom surfaces of the two supports 10 may be planes connected to each other. Optionally, the shape of the shell is not limited to ellipse, and different shapes can be used according to different bullet types and sizes. The shell may be made of rigid plastics or bakelite or metal material such as aluminum alloy. In favor of carrying, a lifting lug may be provided on the shell 1. For example, a through hole 11 for allowing a hanging rope to pass through or a suspension loop is provided at the tail of the shell 1; or a hanging rope and the like may be directly fixed on the shell by a screw.

As shown in FIGS. 2, 6, 7 and 10, the device for loading bullets into a firearm magazine further comprises the inner chamber 2 that is disposed within the shell 1 and extends in a lengthwise direction. The width of the inner chamber 2 is equal to or greater than the maximum diameter of the bullets. It should be understood that the width of the inner chamber 2 is slightly greater than the maximum diameter of the bullets. For example, if the maximum diameter of the bullets is 8 mm, the width of the inner chamber 2 may be 8.4 mm. The cross-sectional shape of the bottom of the inner chamber 2 corresponds to the shape of bullet heads, for example, V-shaped grooves match with conical bullet heads (also referred to as pointed bullet heads), and U-shaped grooves match with spherical bullet heads (also referred to as circular arc bullet heads). The cross-sectional shape of the grooves will also vary depending upon the shape of the bullets. In short, in principle, the bullets in the inner chamber 2 are linearly arranged in a straight line, so that the loading of the bullets is smoother and faster.

Figure 2:
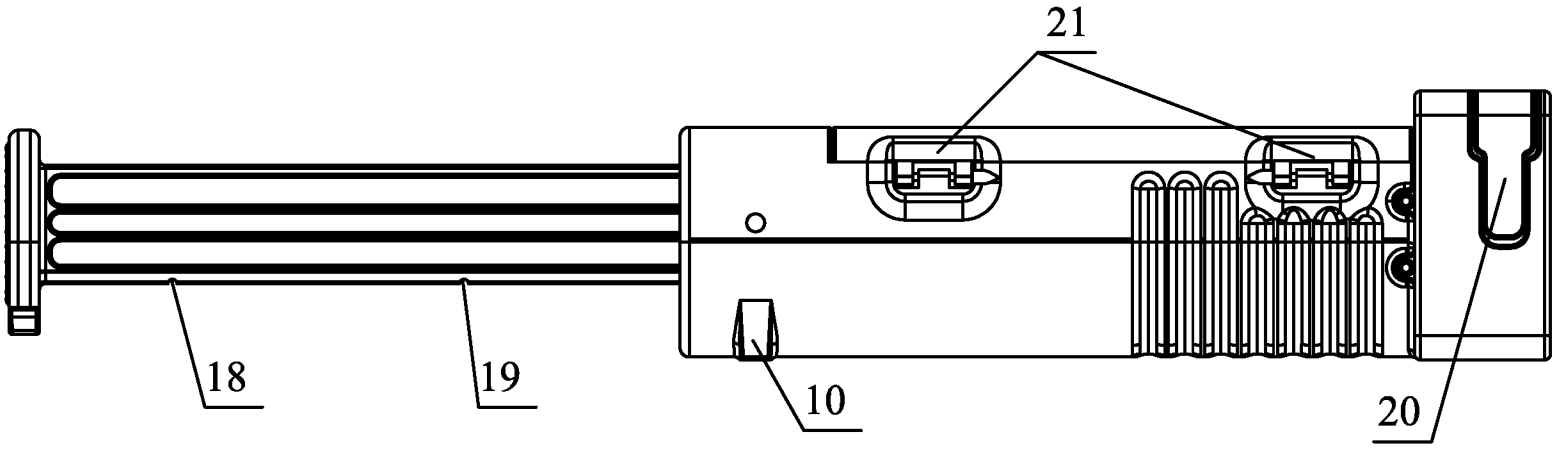
FIG. 2 is a back view of the device for loading bullets into a firearm magazine in FIG. 1.
Figure 3:
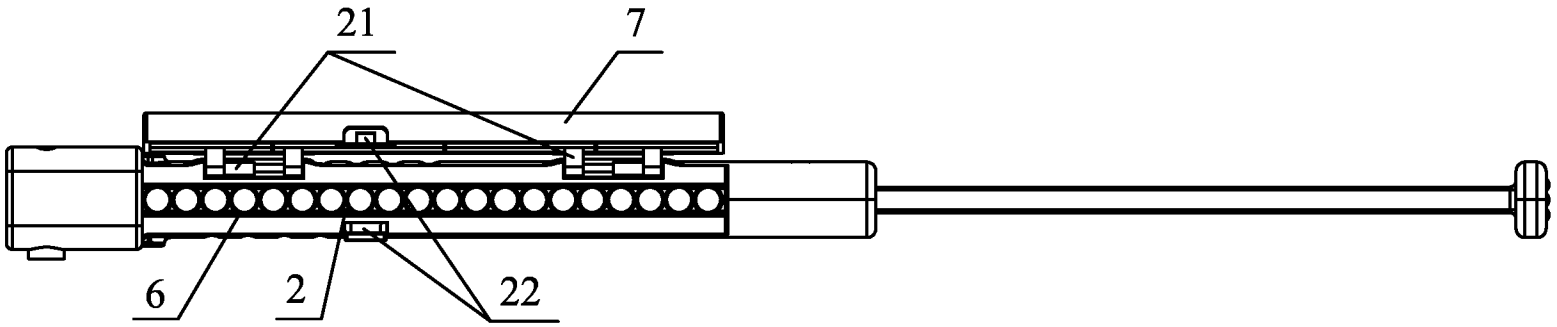
FIG. 3 is a schematic diagram of the device for loading bullets into a firearm magazine in FIG. 1, with an opened top cover and loaded bullets.
Figure 4:
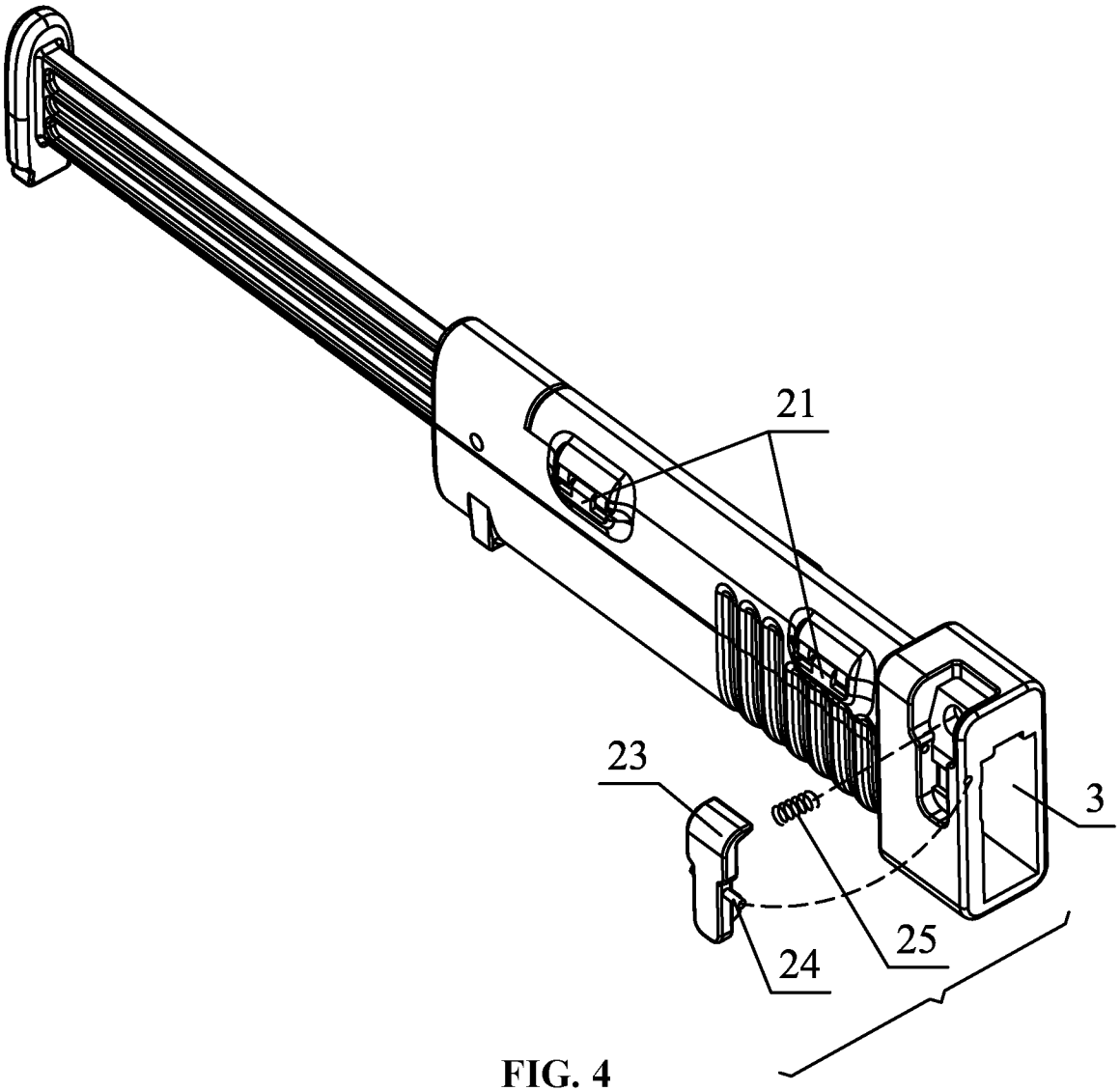
FIG. 4 is an exploded view of a locking device of the device for loading bullets into a firearm magazine in FIG. 1.
Figure 5:
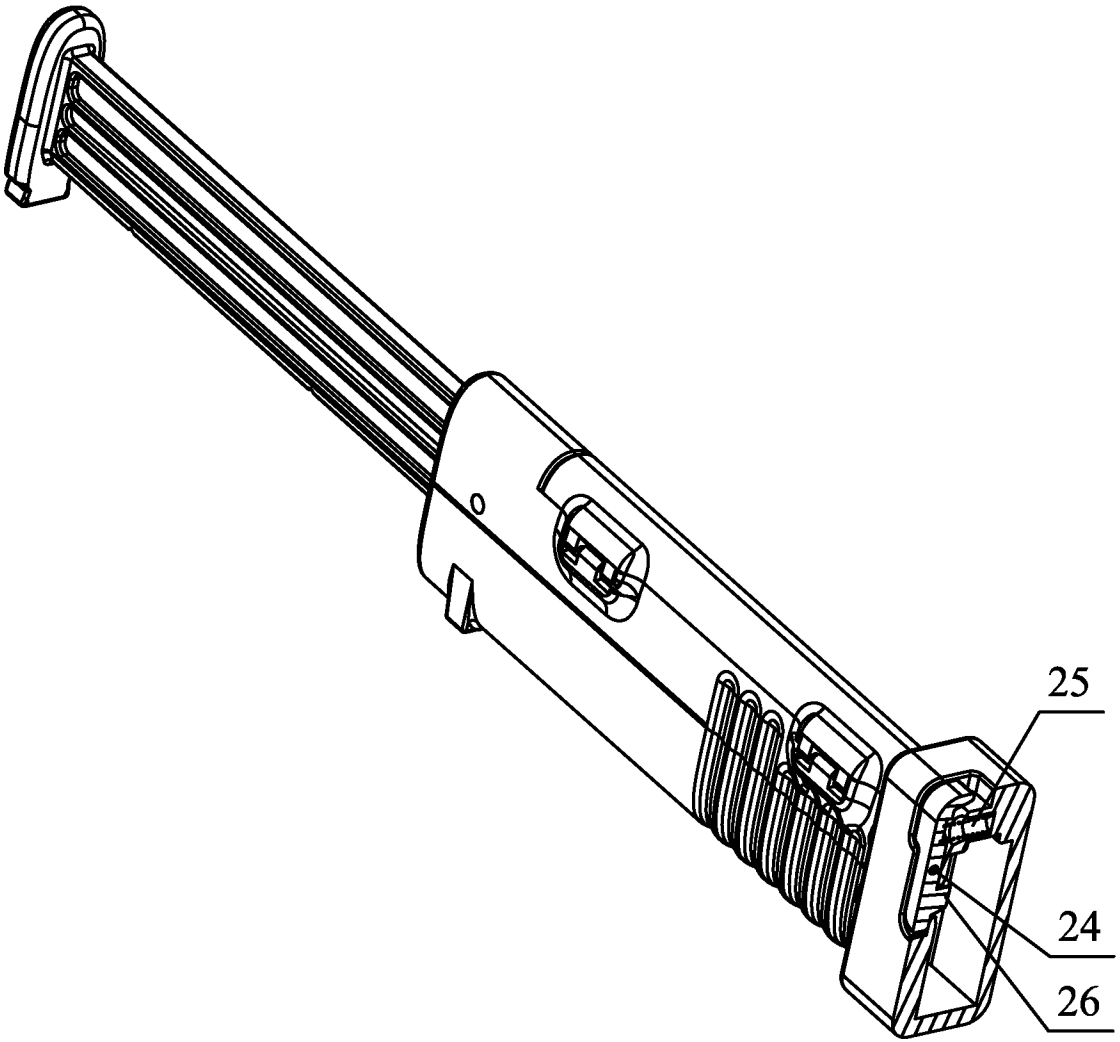
FIG. 5 is a sectional view of a locking device of the device for loading bullets into a firearm magazine in FIG. 1.

As shown in FIGS. 2, 4 and 5, the device for loading bullets into a firearm magazine further comprises the first opening 3 adapted to receive bullets. The first opening 3 is formed at one end of the shell 1 and communicates with the inner chamber 2. The first opening 3 may also be referred to as a magazine interface or a magazine clip connector. The magazine is also referred to as a bullet magazine or a magazine clip. The cross-sectional area of the shell 1 at the first opening 3 is generally greater than the cross-sectional area of the shell 1 on which the inner chamber 2 is located.

The shell 1 comprises a locking device disposed on the first end and adapted to fix the magazine on the shell 1. With the above structure, the abnormal disengagement of the magazine from the shell can be prevented in the process of loading bullets into the magazine, so that the device is highly reliable.

Different firearms are provided with various types of magazines, and each type of magazines corresponds to a different access port, so that the size, shape and clamping position of the first opening 3 may be different. However, the connection structure, connection relation and connection position of the first opening 3, the shell 1 and the inner chamber 2 remain basically unchanged. The first opening 3 of the device can be widely applied to various magazines for rifles and pistols. All the technical solutions comprising the first opening 3 shall fall into the protection scope of the disclosure. The locking device for avoiding the non-artificial disengagement of the magazine from the shell 1 shall also fall into the protection scope of the disclosure.

As shown in FIGS. 2, 4, 5 and 10, a first embodiment of the third opening in the disclosure will be described by taking a magazine of a rifle such as an AR15 magazine as example.

The first opening 3 is a rectangle extending up and down. The locking device 20 comprises a first hinged shaft 24, a first locking block 23 comprising an upper end and a lower end and being hinged to the outer wall of the shell 1 through the first hinged shaft 24, a first lug 26 connected to the lower end of the first locking block 23, and a first reset spring 25 disposed on the outer wall of the shell 1 and communicating with the upper end of the first locking block 23. The first lug 26 runs through a through hole on the outer wall of the shell, extends into the first opening 3 and matches with the groove on the outer sidewall of the magazine to lock or unlock the magazine. The upper end of the first locking block 23 abuts against the first reset spring 25 to lock the first lug 26 in a natural state. After the magazine is loaded in the first opening 3, the first locking block 23 is compressed by the first reset spring 25, so that the magazine is fixed by the first lug 26. By pressing down the first locking block 23 to overcome the spring force, the first lug 26 is allowed to unlock the groove of the magazine so that the magazine can be taken out.

Figure 11:
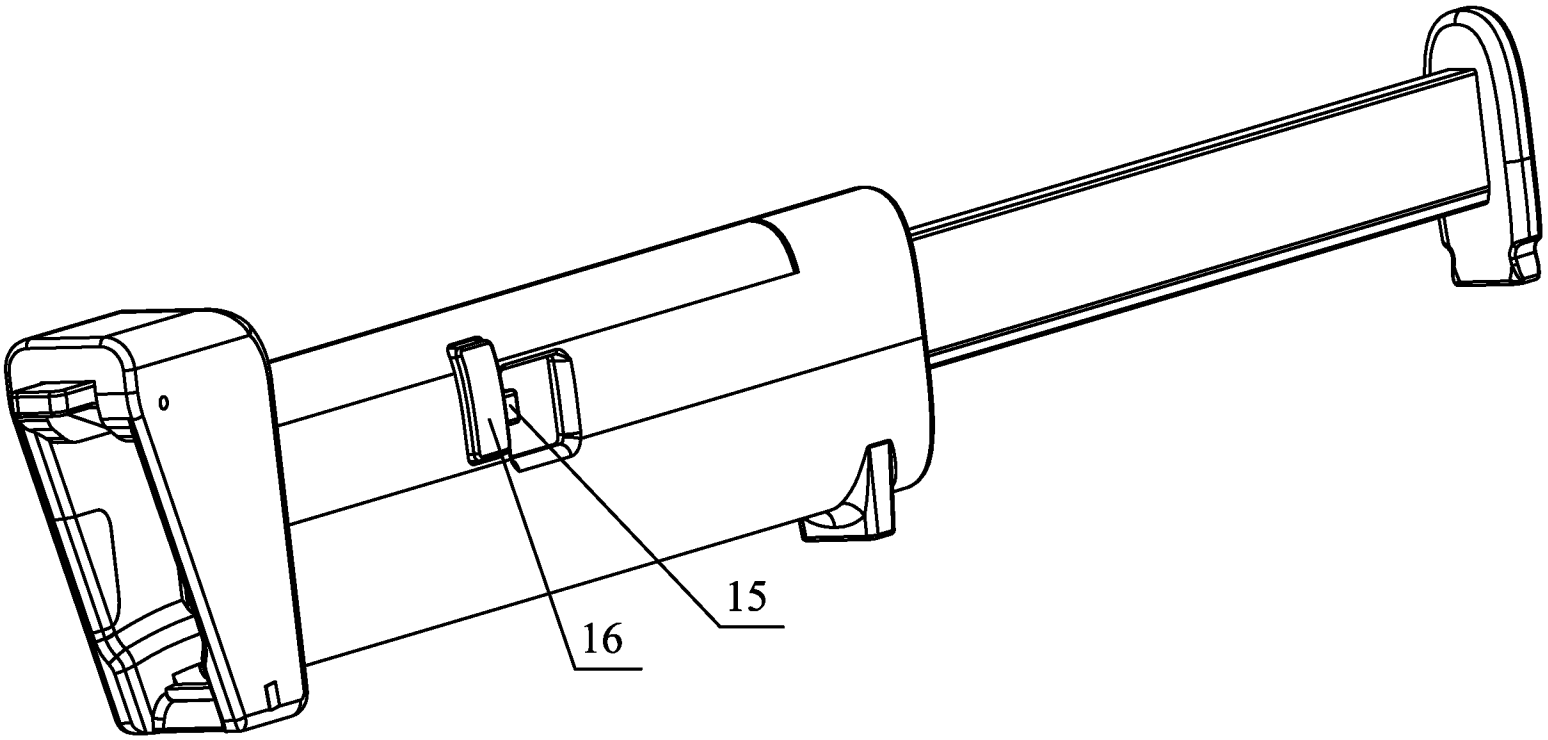
FIG. 11 is a schematic diagram of a device for loading bullets into a firearm magazine, where an elastic locking assembly is disposed on the shell.
Figure 12:
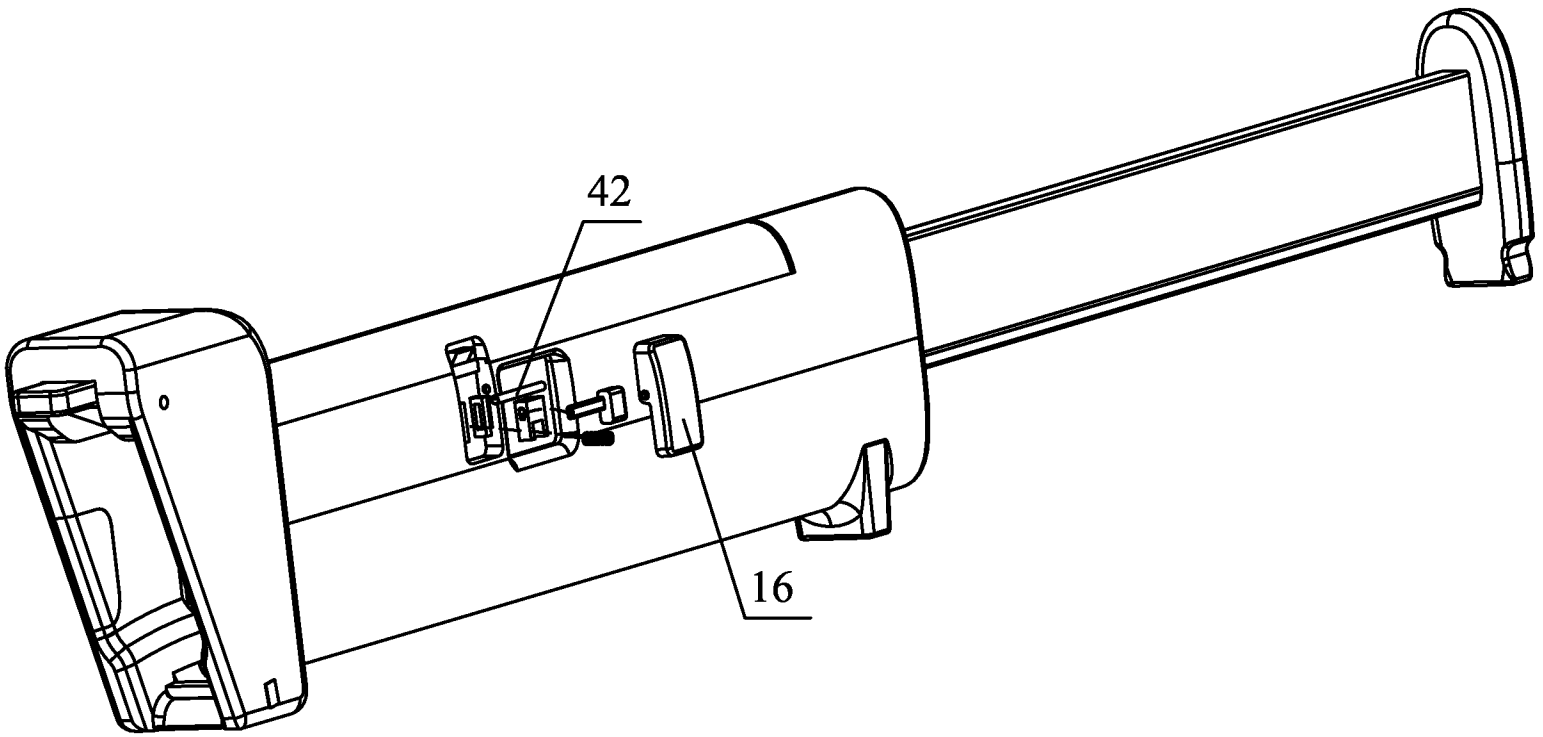
FIG. 12 is an exploded view of the elastic locking assembly of FIG. 11.
Figure 13:
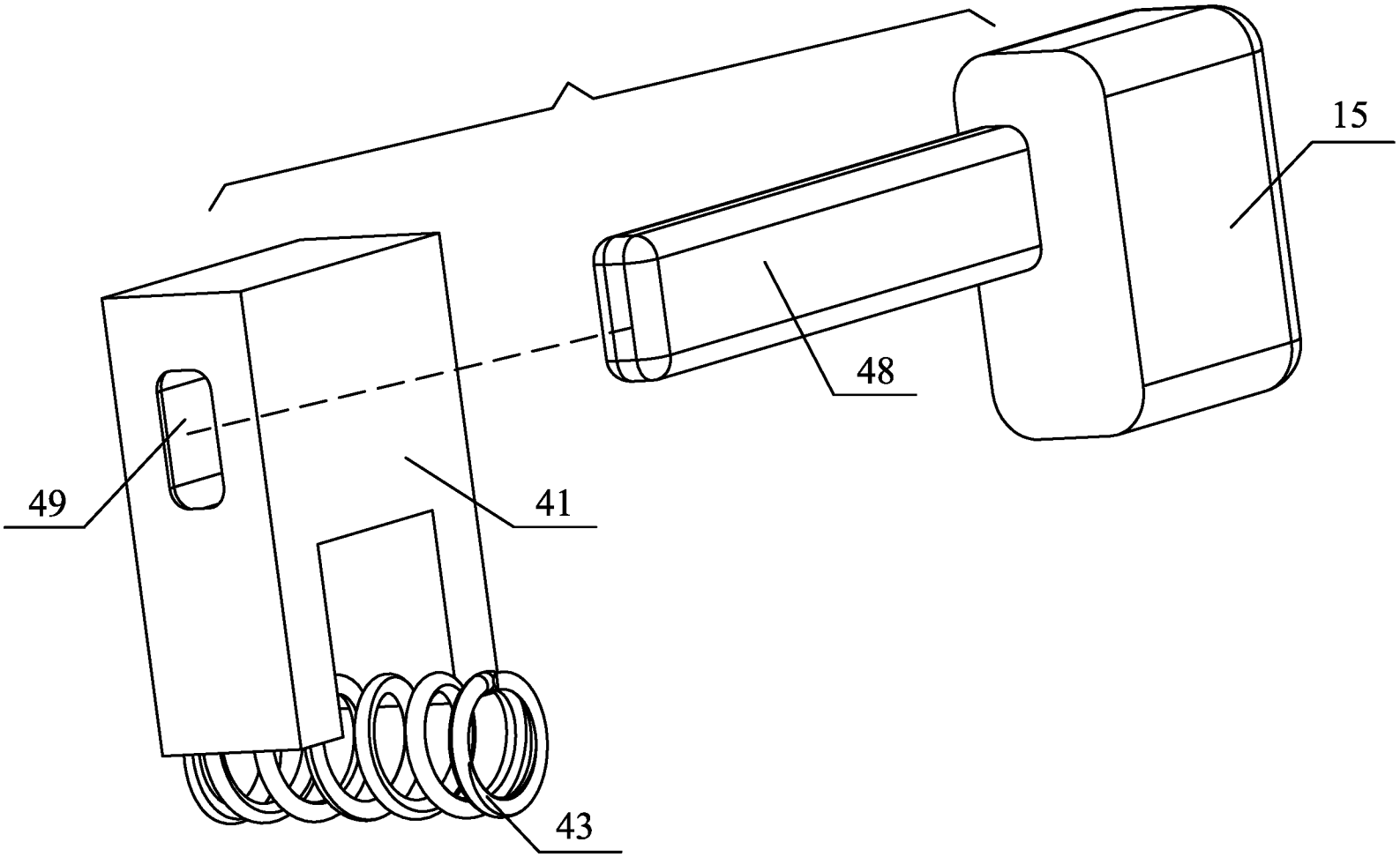
FIG. 13 is an enlarged exploded view of the elastic locking assembly of FIG. 12.
Figure 15:
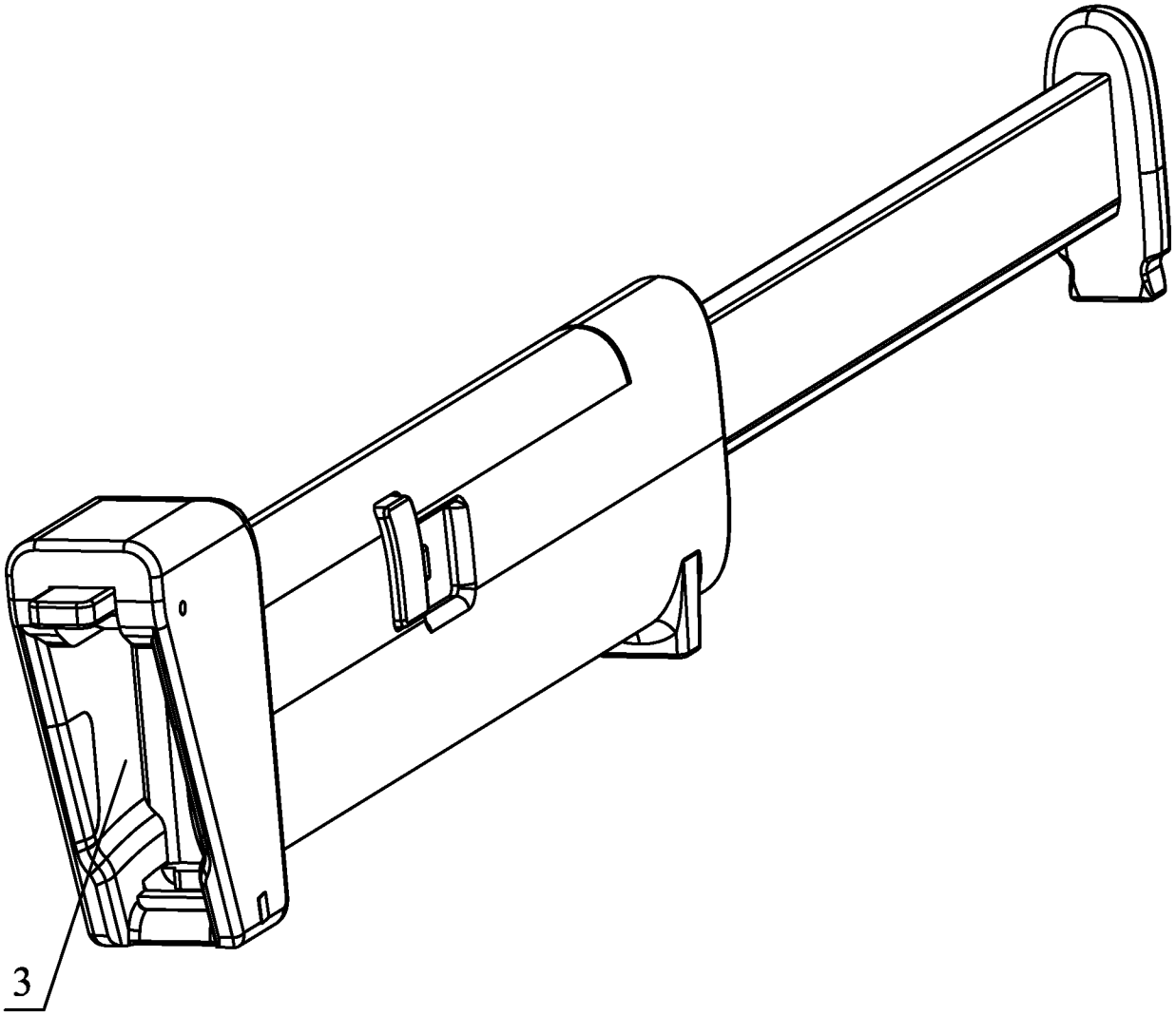
FIG. 15 is another schematic diagram of a device for loading bullets into a firearm magazine (used with another magazine of a rifle) according to the disclosure.
Figure 16:
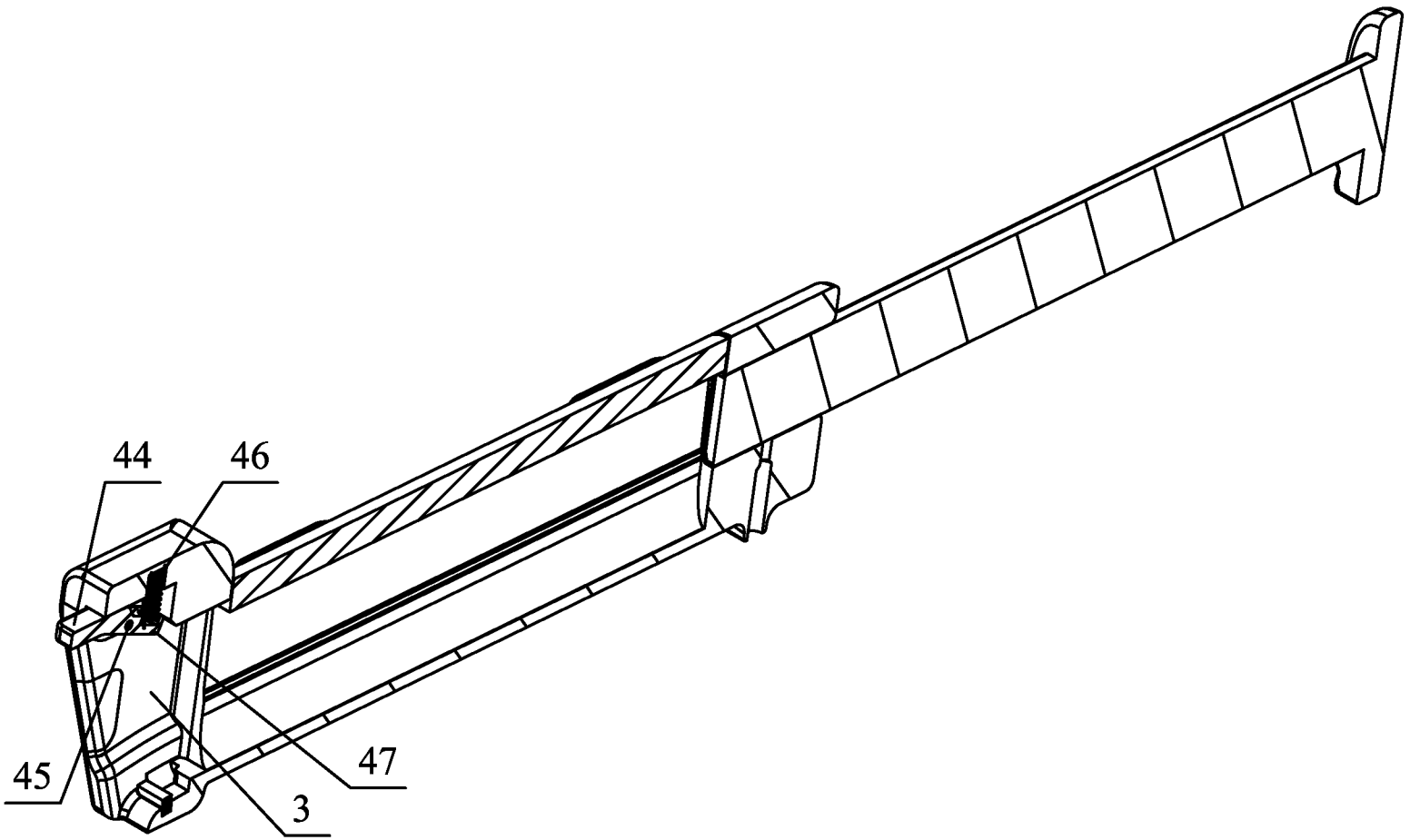
FIG. 16 is a longitudinally sectional view of FIG. 15.

As shown in FIGS. 11, 15 and 16, a second embodiment of the third opening in the disclosure will be described by taking a magazine of a rifle such as an AK47 magazine as example.

The basic structure is the same as that in the first embodiment, except for the following difference: to avoid interference, the front end face of the first end is designed as an inclined plane matched with the arc-shaped magazine, which inclines from the top down and has a thicker upper part and a thinner lower part, and the first opening 3 is approximately a trapezoid having a wider upper part and a narrower part from the perspective of its longitudinal section. The structure of the locking device is also different: the locking device comprises a second hinged shaft 45, a second locking block 44 hinged to the inner top wall of the shell 1 through the second hinged shaft 45, a second lug 47 connected to the lower end of the second locking block 44, a second reset spring 46 disposed on the inner wall of the shell 1 and communicating with the second locking block 44. The second lug 47 matches with the groove on the wall of the magazine to lock or unlock the magazine. The second locking block 44 abuts against the second reset spring 46 to lock the second lug 47 in a natural state. After the magazine is loaded in the first opening 3, the second locking block 44 is compressed by the second reset spring 46, so that the magazine is fixed by the second lug 47. By pressing down the second locking block 44 to overcome the spring force, the second lug 47 unlocks the groove of the magazine so that the magazine can be taken out.

Figure 17:
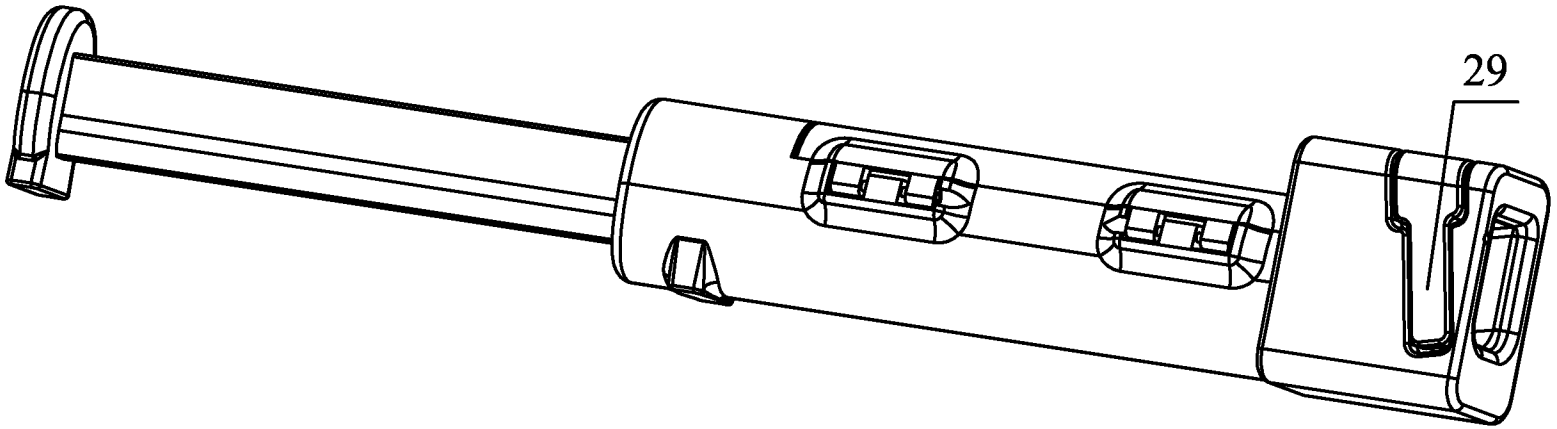
FIG. 17 is a schematic diagram of a device for loading bullets into a firearm magazine (used with a magazine of a pistol) according to the disclosure.
Figure 18:
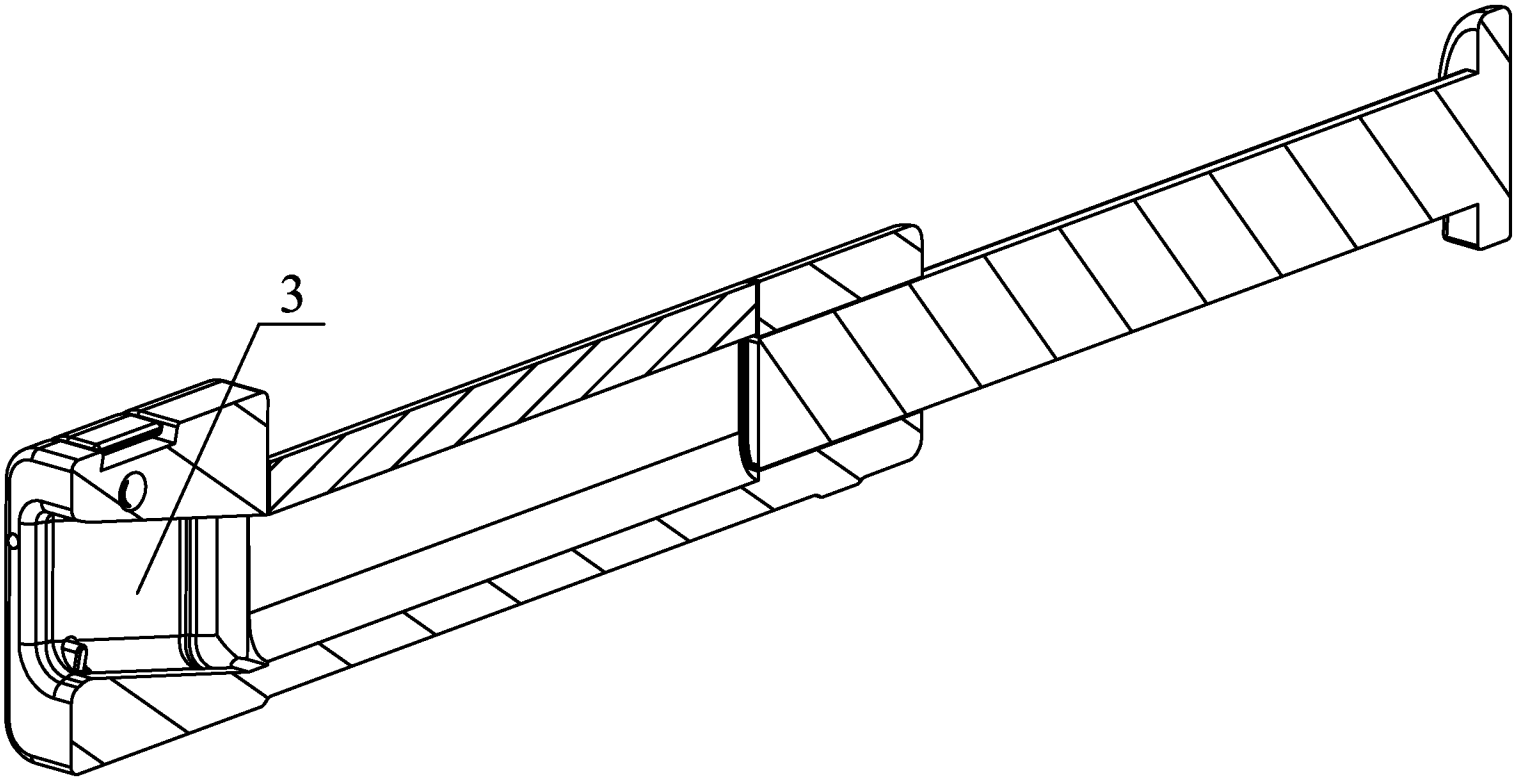
FIG. 18 is a longitudinally sectional view of FIG. 17.

As shown in FIGS. 17 and 18, a third embodiment of the third opening in the disclosure will be described by taking a magazine of a pistol such as a magazine of a 9MM pistol as example.

The basic structure is the same as that in the first embodiment, except for the following difference: the first opening 3 is a channel which is inclined from outside to inside and has parallel upper and lower sides, and the magazine is inclined in such a way that its exterior is higher and its interior is lower after the magazine of the pistol is loaded. The locking device is also slightly different: the fourth locking block 29 is inclined from upper left to lower right to match with the inclined first opening 3, and a lug matching with the groove of the magazine to lock or unlock the magazine is provided on the front inner bottom wall of the third opening.

Figure 6:
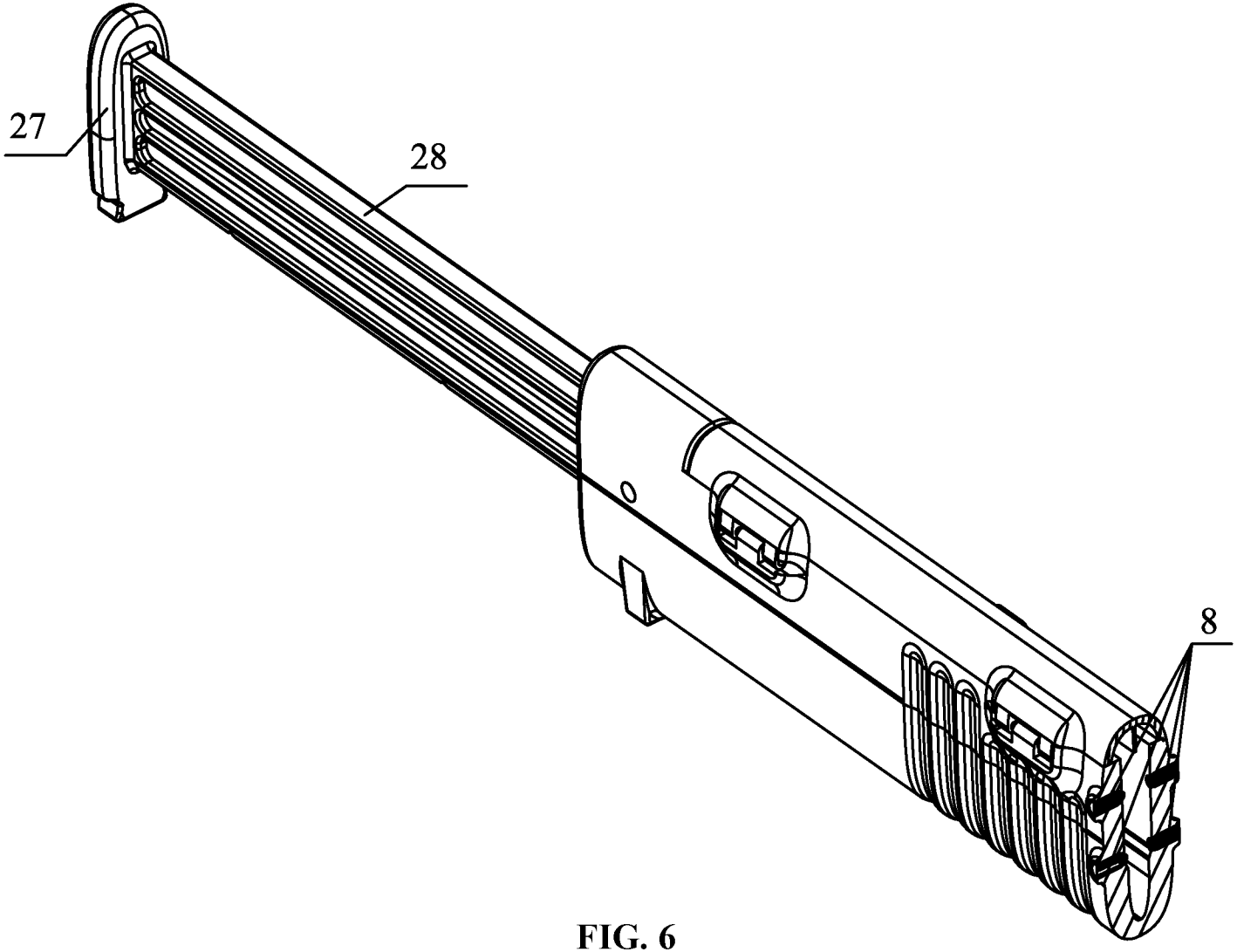
FIG. 6 is a schematic diagram of the device for loading bullets into a firearm magazine in FIG. 1, where a spring-loaded clamp is mounted on the shell.
Figure 7:
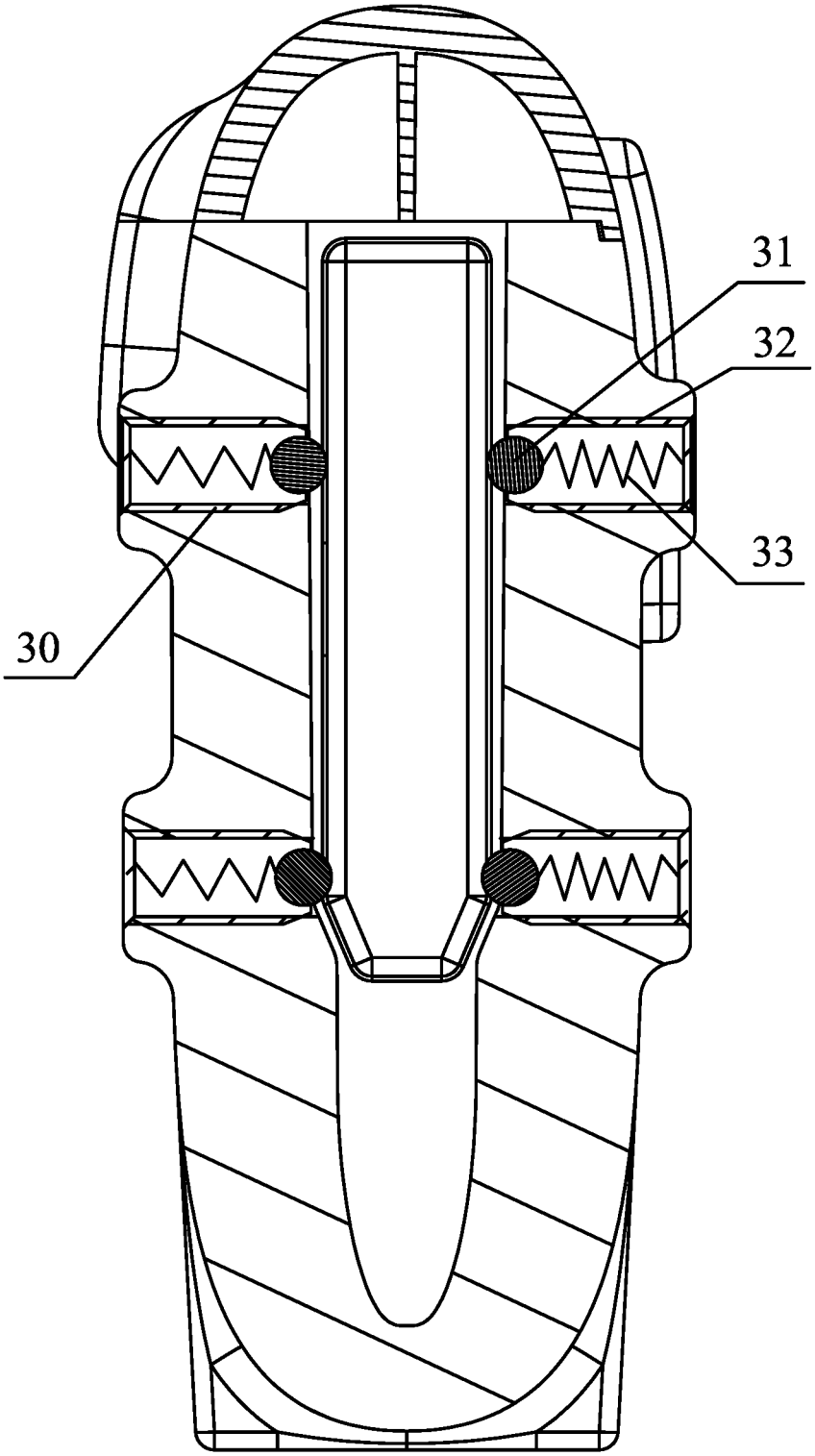
FIG. 7 is an enlarged front view of FIG. 6.
Figure 8:
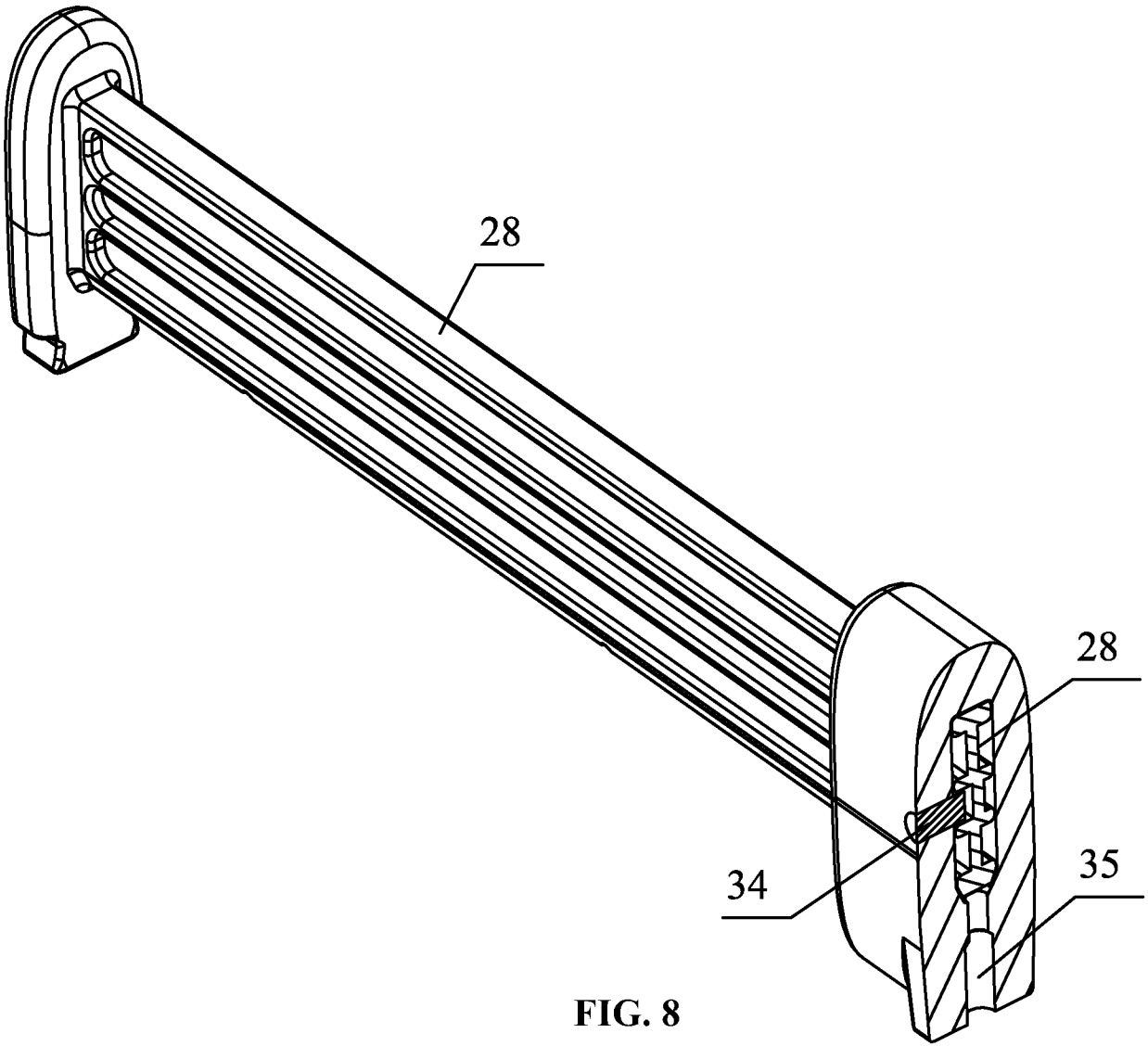
FIG. 8 is a schematic diagram of the device for loading bullets into a firearm magazine in FIG. 1, where a limiting pin is disposed on the shell.
Figure 9:
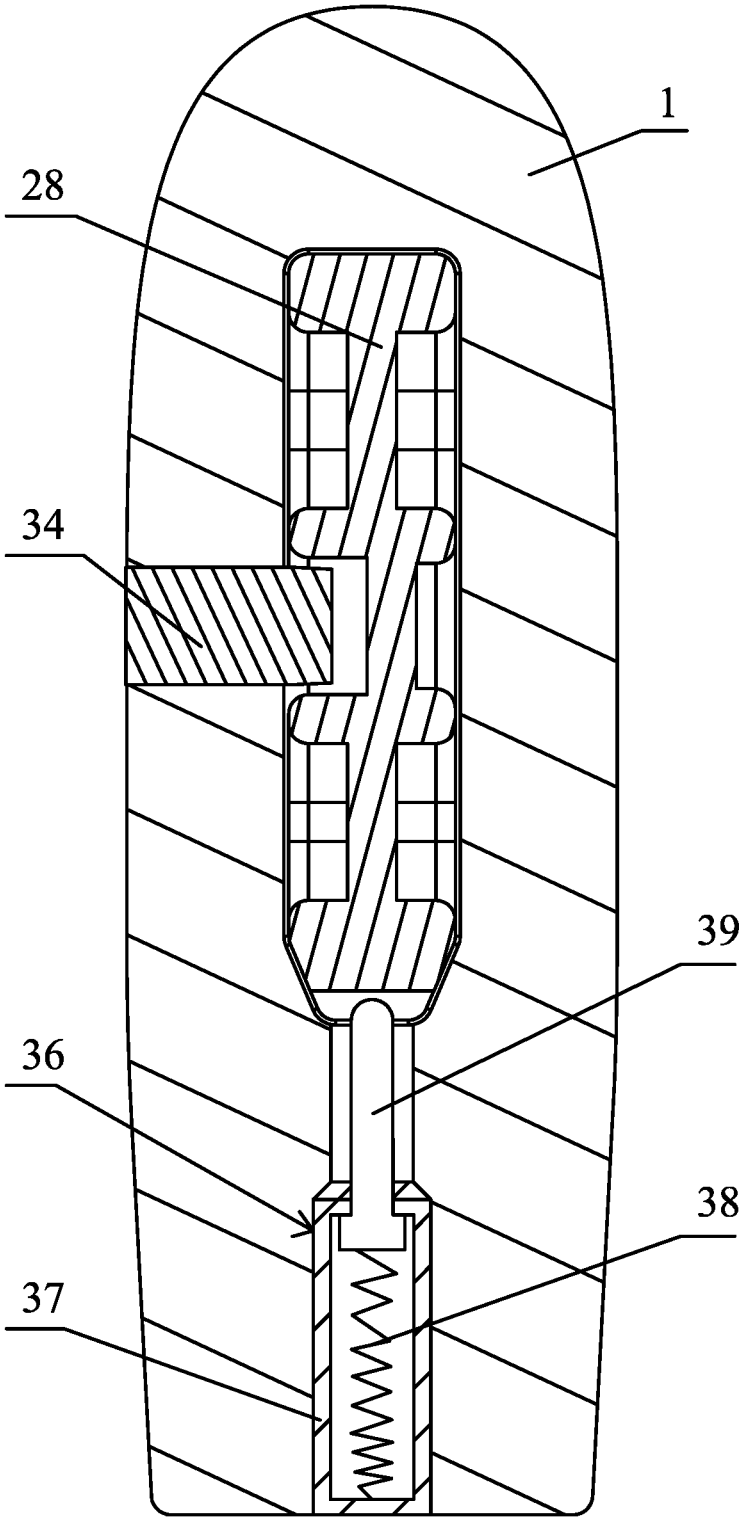
FIG. 9 is an enlarged front view of FIG. 8 (a spring-loaded clip is shown)

As shown in FIGS. 1, 6 and 7, at least one spring-loaded clamp 8 for preventing bullets from popping in a magazine unloaded state is provided on each of two sidewalls of the shell 1 in the vicinity of the first opening 3. The spring-loaded clamps 8 are symmetrically-arranged on two sidewalls of the shell 1. Depending upon the size of bullets, one or two spring-loaded clamps may be symmetrically provided on each sidewall. Preferably, two spring-loaded clamps are provided on each sidewall. The two spring-loaded clamps 8 are located in the middle section of the shell 1 in a height direction, and the two spring-loaded clamps 8 are spaced apart and are located on the same plumb line. Optionally, three spring-loaded clamps may also be provided on each sidewall. The spring-loaded clamp 8 preferably employs the following structure: the spring-loaded clamp 8 comprises a second cylinder 32, a second compression spring 33 disposed in the second cylinder 32, and a metal ball 31 attached to the second compression spring 33. The diameter of the opening of the second cylinder 32 is less than the diameter of the metal ball 31, thus preventing the metal ball 31 from separation from the second cylinder 32, that is, the metal ball 31 can protrude into the inner chamber 2 to clamp the bullets and prevent the ejection of the bullets out of the shell, but cannot leave out of the second cylinder. The spring-loaded clamp 8 is disposed in a first through hole 30 on the outer wall of the shell 1 in the vicinity of the first opening, and the metal ball 31 extends into the inner chamber 2 under the elastic force of the second compression spring 33 to block the bullets. Optionally, the spring-loaded clamp 8 may also employ a spring-loaded clip 36 which will be detailed hereinafter, that is, the spring-loaded clamp 8 may be interchanged with the spring-loaded clip 36.

Figure 10:
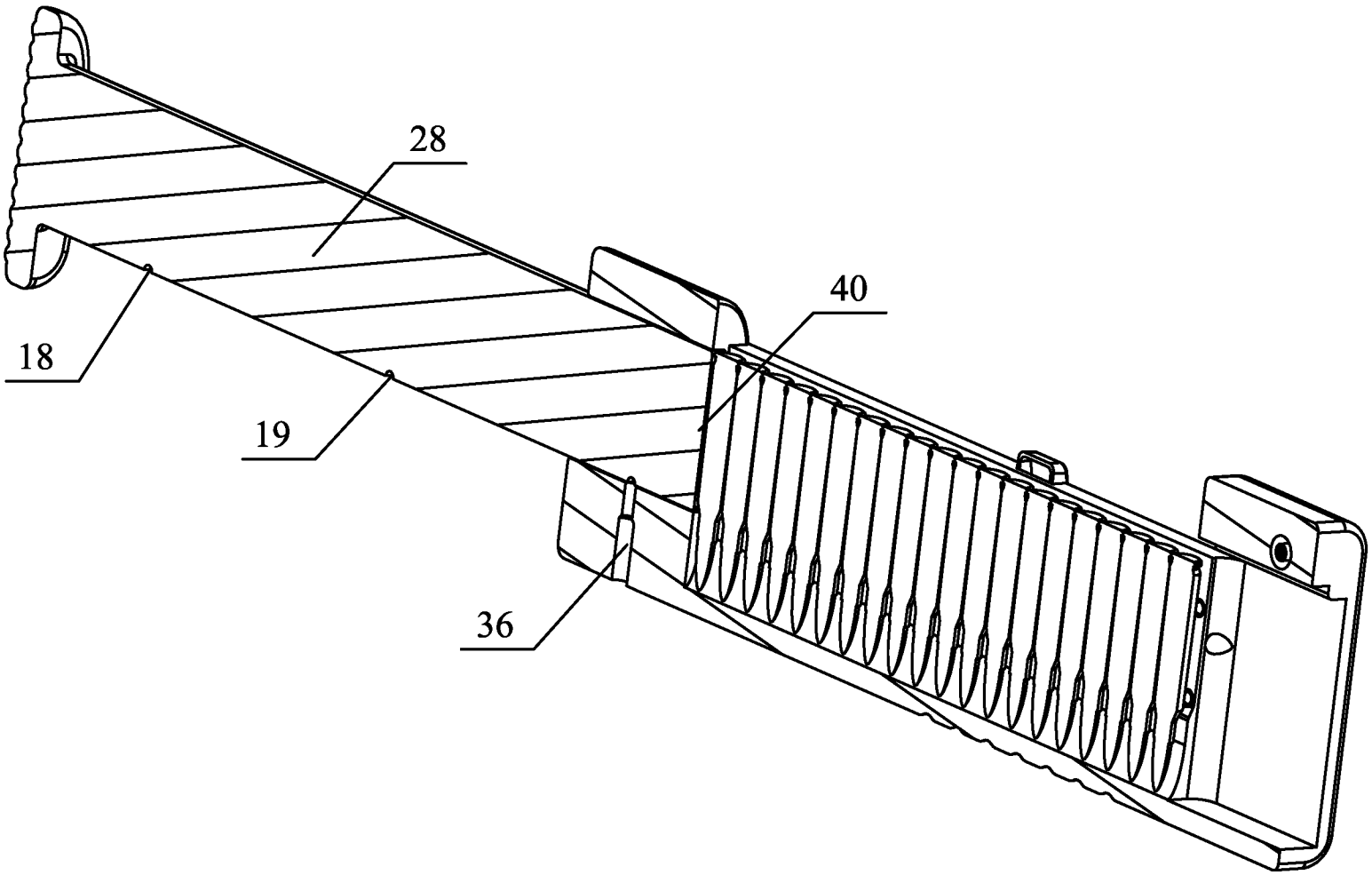
FIG. 10 is a longitudinally sectional view of the device for loading bullets into a firearm magazine in FIG. 1, where bullets have been loaded.
Figure 14:
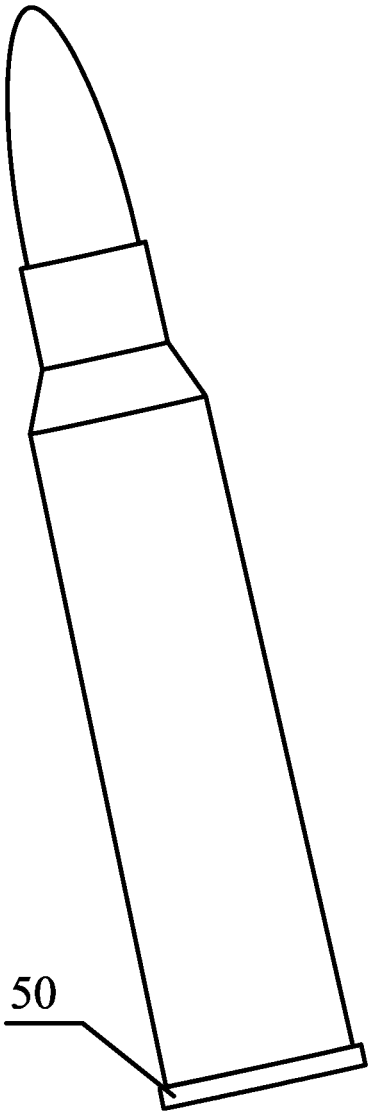
FIG. 14 is a structure diagram of a bullet with a radial convex ring to be mounted in an inner chamber of the device of the disclosure.

As shown in FIGS. 1, 10 and 14, the pushrod 4 is slidably fitted with the shell and moves in the inner chamber to drive the linearly arranged bullets into a magazine. The pushrod 4 extends out of the second opening 5 of the shell 1. The pushrod 4 comprises a head 40, a main body 28 and a handle 27. With the above structure, the operation of loading bullets into the magazine is more accurate, faster and more time-saving. The cross-sectional shape and size of the head 40 may be matched with the shape and size of bullet bodies. In this embodiment, the height of the second opening 5 is less than the height of the inner chamber 2, and the size and shape of the head 40 are matched with the cross-sectional size and shape of the second opening, i.e., the shape and size of bullet bodies. Accordingly, the requirements of pressing most bullets such as AR15 into the magazine can be satisfied. Meanwhile, in this embodiment, the main body 28 and the head 40 are the same in terms of the cross-sectional size and shape. In some cases, the size and shape of the head may also be matched with that of the bullets according to different shapes of the bullets. As shown in FIG. 14, a radial convex ring 50 is provided at the tail of the bullet. To linearly and quickly press bullets in the inner chamber into the magazine, the acting point of the head may be concentrated on the radial convex ring 50, and a protruded-inward press block may be provided at the position on the pushrod corresponding to the radial convex ring. In conclusion, the shape of the head of the pushrod is designed on the basis of the effective stressing of the linearly arranged bullets. The head mainly functions to align with the acting point of the linearly arranged bullets to the greatest extent, so that the bullets are effectively, linearly and quickly pushed forward and thus pressed into the magazine.

As shown in FIGS. 1, 2, 8, 9 and 10, the second end of the shell 1 defining the second opening 5 is provided with a spring-loaded clip 36 for positioning the final position of the main body 28 and indicating the number of loaded bullets. The bottom of the main body 28 is provided with a positioning groove 18 and a reminding groove 19 corresponding to the spring-loaded clip 36. When the main body 28 is withdrawn to the final position, the pushrod 4 is located at a non-operating position.

The spring-loaded clip 36 employs the following structure: the spring-loaded clip 36 comprises a first cylinder 37, a first compression spring 38 disposed within the first cylinder 37, and a locating pin 39 connected to the first compression spring 38. A limiting structure for preventing the locating pin 39 from separating from the first cylinder 37 is provided on the first cylinder 37. The spring-loaded clip 36 is provided in the second through hole 35 formed on the bottom wall of the shell 1. The locating pin 39 protrudes into the inner chamber 2 under the elastic force of the first compression spring 38 and can play a positioning or indicating role when it is embedded in the positioning groove 18 or the reminding groove 19 on the main body 28. Optionally, as described above, the spring-loaded clip 36 may also employ the structure of the spring-loaded clamp 8 described above, that is, the structure of the spring-loaded clip 36 may be interchanged with the structure of the spring-loaded clamp 8. The positioning groove 18 may be regarded as a mid-position clamping point of the main body 28. The reminding groove 19 can be interpreted as follows: if the distance of a predetermined number of bullets such as ten bullets is preset according to the length of the main body 28, for example, a magazine accommodating ten bullets, the reminding groove will be clamped for indication after the bullets are loaded. In general, the spring-loaded clip 36 has two functions: after the pushrod 4 is withdrawn in a non-operating state, the motion of the pushrod 4 is avoided because the main body 28 is withdrawn to the inner chamber 2 and clamped within the positioning groove 18, so that the positioning function is realized. However, in the process of loading (filling) bullets, if the magazine has a capacity of twenty bullets, a reminding groove 19 is provided at the position of ten bullets. When the spring-loaded clip 36 falls into the reminding groove 19, the operator is indicated that ten bullets have been loaded into the magazine. If a magazine having a capacity of ten bullets is used, when the spring-loaded clip 36 falls into the reminding groove, the operator is indicated that ten bullets have been loaded into the magazine, and the operator is indicated that the remaining ten bullets will be continuously loaded after a new magazine is mounted. The groove may also be referred to as a gap, preferably, a V-shaped groove or inverse V-shaped gap.

A first limiting structure for preventing the head 40 of the pushrod 4 from disengagement from the shell 1 is provided on the sidewall of the shell 1. The first limiting structure is, for example, a convex column, a pin, a bolt or the like. A guide rail 12 extending in a lengthwise direction is provided on at least one side of the main body 28. A second limiting structure matching with the first limiting structure is provided on the guide rail 12. The first limiting structure on the sidewall is preferably a limiting pin 34. By the coordination of the limiting pin 34 with the second limiting structure such as a limiting block at the inner end of the guide rail 12, the main body is prevented from being pulled out of the inner chamber 2. Generally, one side of the main body is provided with the guide rail 12 to coordinate with the limiting pin 34, thus saving the material without influencing the strength of the main body 28. Optionally, two sides of the main body 28 are provided with the guide rails 12 for purpose of symmetrical and beautiful appearance.

As shown in FIGS. 1 and 15, the end area of the handle 27 is greater than the cross-sectional area of the main body 28. The shape of the end face of the handle 27 is roughly a rectangle extending up and down, with at least one right-angled corner 13 for pulling bullets out of the magazine. Two lower corners are right-angled. The handle 27 with the right-angled corner 13 may be regarded as a pull plate with square bullet discharging corners. When it is necessary to discharge bullets from the magazine, the right-angled corner 13 may be used. Two upper corners may be arced corners for convenience of holding the handle. With the above structure, the loading device can also have a function of unloading bullets from the magazine, so that the loading device has more practicability. A plurality of antiskid protrusions 14 is provided on the rear end face of the handle 27 to increase the friction.

As shown in FIGS. 1, 3, 11, 12 and 13, a third opening 6 adapted to receive bullets is formed on the shell 1 on the top of the inner chamber 2. The length of the third opening 6 is preferably equal to the length of the inner chamber 2. Scale lines may be provided on the outer wall of the shell corresponding to the third opening 6, so that the number of loaded bullets can be known at any time. A top cover 7 is provided to open and close the third opening 6, and the top cover 7 is preferably a protruded-upward semi-circle. One end of the top cover 7 is fixed on one sidewall of the shell through an elastic hinge 21, and an elastic locking assembly 9 is provided on the other sidewall of the shell to cooperate with the top cover. With the above structure, after the top cover 7 is closed, the bullets can be prevented from bouncing in the inner chamber 2, and the top cover plays a guide role for bullets, so that the bullet pressing process is smoother and more labor-saving, and it is very convenient and quick for closing or opening the top cover 7. A lock/unlock mark may be provided on the outer wall of the shell 1 in the vicinity of the elastic locking assembly 9, to explicitly informing the operator of the state of the elastic locking assembly 9.

The elastic locking assembly 9 comprises a third locking block 16 hinged to the wall of the shell 1 on the top of the inner chamber 2 through a third hinged shaft 42, hook and catch ends 22 provided on the inner side of the top end of the third locking block 16 and the inner side of the top cover, and a third reset spring 43 provided on the wall of the shell 1 in the lower portion of the third locking block 16. The elastic locking assembly 9 further comprise a locking switch which is provided on the wall of the shell 1 for avoiding the inward compression of the lower portion of the third locking block 16 and the abnormal disengagement of the hook and catch ends, thus preventing the abnormal opening of the top cover 7. The locking switch comprises a U-shaped protective block 41 which extends into the inner side of the third locking block 16, and is located above or surrounds the third reset spring 43. The U-shaped protective block 41 is connected to a lifting block 15 that laterally extends out of the third locking block 16 and can ascend and descend. The lifting block 15 comprises an extension rod 48, and the U-shaped protective block comprises a third through hole; the extension rod 48 is inserted into the third through hole 49. When the U-shaped protective block 41 descends to surround three sides (i.e., left, upper and right sides) of the third reset spring 43 or half-surrounds the third reset spring 43, the lower part of the third locking block 16 cannot disengage the hook and catch ends 22 even if it is pressed. Consequently, in the non-operating state, the device will not be damaged due to the abnormal opening the top cover due to the accidental touch of the third locking block 16.

The elastic hinge 21, for example, a hinge made of rubber, has the characteristic of automatically unlock the top cover 7. Optionally, it is also possible to dispose a spring or leaf spring on the hinged shaft of the hinge to automatically unlock the top cover 7. When the top cover 7 is closed, the top cover 7 is automatically locked by the hook and catch ends 22. Lifting the lifting block 15 can release the third locking block 16. When the third locking block 16 is pressed down, the top cover 7 is automatically opened, and the device enters an operating state. In the non-operating state, the top cover 7 is closed, and the hook and catch ends 22 are locked automatically. When the lifting block 15 moves downward, the third locking block 16 is locked. After the third locking block 16 is locked, even if it is pressed by an external force, and the top cover 7 will not open.

Optionally, the top cover 7 mainly functions to prevent the bullets in the inner chamber 2 from bouncing up and down. Therefore, other structures such as a groove-type push/pull top cover are also practicable.

The top cover 7 is of transparent material such as glass, organic glass or transparent plastics. With the above structure, the number of the bullets in the inner chamber can be directly seen.

The method for operating the device for loading bullets into a firearm magazine is as follows.

An empty magazine is inserted into the first opening.

The lifting block 15 is lifted to release the locked state of the third locking block 16. The third locking block 16 is pressed down, and the top cover 7 is automatically opened. The pushrod 4 is pulled to the tail end of the inner chamber 2 to check whether the inner chamber 2 empty and clean.

Bullet heads are oriented to face downward along the inner chamber 2, and the inner chamber 2 is fully loaded with the bullets. During the loading process, the inclined angle between the head and tail of the shell 1 can be about 30 degrees. Since the magazine and the head face downward, due to the gravity, the bullets can be linearly arranged in order from front to rear.

The top cover 7 is closed.

The shell 1 is held by one hand, the handle 27 of the pushrod 4 is pushed by the other hand, and the bullets in the inner chamber 2 are pushed to the magazine until the magazine is completely filled. This operation can be performed on a table.

If the number of the bullets in the inner chamber 2 is greater than the capacity of the magazine, for example, with regard to a magazine clip accommodating ten bullets, if there are twenty bullets in the inner chamber 2, after ten bullets have been loaded, the spring-loaded clip 36 is embedded in the reminding groove 9, that is, the main body is clamped. Accordingly, the filled magazine should be taken down and replaced with another empty magazine, continuously push the pushrod 4 forward until all the bullets are loaded into the magazine.

When it is necessary to unload the bullets from the magazine, the main body 28 is withdrawn to the shell 1. The shell 1 is held by one hand, the magazine is held by the other hand, and the bullets are pushed out of the magazine one by one using the right-angled corner 13 of the handle 27.

In case no magazine is mounted on the device, and there is no bullet in the inner chamber 2; and the main body 28 is withdrawn to the shell 1 and fixed by the positioning groove 18. Meanwhile, the locking structure locks the hook and catch ends 22 of the elastic locking assembly 9.

It will be obvious to those skilled in the art that changes and modifications may be made, and therefore, the aim in the appended claims is to cover all such changes and modifications.

What is claimed is:

1. A device, comprising:

a shell, the shell comprising an outer wall and an inner chamber confined by the outer wall, the outer wall comprising: a first end comprising a first opening adapted to be connected to a magazine of a firearm, a second end comprising a second opening, and a third opening disposed between the first end and the second end and adapted to pass bullets into the inner chamber;

a pushrod, the pushrod comprising a head, a main body, and a handle, and being connected to the second end and adapted to move in the inner chamber to push the bullets out of the inner chamber to be loaded into the magazine; and a top cover, the top cover disposed on the outer wall and adapted to open and close the third opening;

wherein:

the first opening, the second opening and the third opening are connected to the inner chamber; and the second end is provided with a spring-loaded clip; the main body of the pushrod comprises a positioning groove and a reminding groove; the spring-loaded clip is adapted to be inserted in the positioning groove to position the pushrod in the inner chamber, and the spring-loaded clip is adapted to be inserted in the reminding groove to indicate a count of the bullets that are loaded into the magazine.

2. The device of claim 1, wherein the spring-loaded clip comprises a first cylinder, a first compression spring disposed in the first cylinder, and a locating pin connected to the first compression spring; the first cylinder comprises a first limiting structure for preventing the locating pin from separating from the first cylinder.

3. The device of claim 1, wherein the first end is provided with at least two symmetrically-disposed spring-loaded clamps; the at least two symmetrically-disposed spring-loaded clamps each comprise a second cylinder, a second compression spring disposed in the second cylinder, and a metal ball attached to the second compression spring; and the first end comprises first through holes for accommodating the at least two symmetrically-disposed spring-loaded clamps.

4. The device of claim 1, wherein the first end further comprises a locking device adapted to fix the magazine; the locking device comprises a first hinged shaft, a first locking block comprising an upper end and a lower end and being hinged to the first end via the first hinged shaft, a first lug connected to the lower end of the first locking block, and a first reset spring disposed on the first end and abutting against the upper end of the first locking block.

5. The device of claim 1, wherein the second end comprises a second through hole and the spring-loaded clip is disposed in the second through hole.

6. The device of claim 1, wherein the second end comprises a second limiting structure; at least one side surface of the main body of the pushrod is provided with a guide rail which engages with the second limiting structure to block the head of the pushrod from disengagement from the shell.

7. The device of claim 6, wherein the second limiting structure is a convex column, a pin, or a bolt.

8. The device of claim 1, wherein an end face of the handle has an area greater than a cross-section of the main body.

9. The device of claim 8, wherein an end face of the handle is in a rectangular shape.

10. The device of claim 9, wherein the end face of the handle comprises a plurality of antiskid protrusions.

11. The device of claim 1, wherein a cross-section of the shell is in an elliptical shape, and the outer wall comprises a plurality of skidproof stripes close to the first end.

12. The device of claim 1, wherein the second end is provided with at least two mutually symmetrical supports.

13. The device of claim 1, wherein the top cover is a semicircle in a cross-section; the outer wall comprises a first sidewall and a second sidewall, and the third opening is disposed between the first sidewall and the second sidewall; one end of the semicircle is fixed on the first sidewall through an elastic hinge, and the other end of the semicircle is connected to an elastic locking assembly disposed on the second sidewall.

14. The device of claim 13, wherein the elastic locking assembly comprises a second hinged shaft, a second locking block hinged to the second sidewall via the second hinged shaft, a second reset spring disposed on the second sidewall and adapted to press a lower end of the second locking block.

15. The device of claim 14, wherein the second locking block comprises a hook end, and the semicircle comprises a catch end adapted to engage with the hook end.

16. The device of claim 15, wherein the elastic locking assembly further comprises a locking switch disposed in the second locking block.

17. The device of claim 16, wherein the locking switch comprises a U-shaped protective block and a lifting block; the U-shaped protective block comprises a third through hole; the lifting block comprises an extension rod disposed in the third through hole.

18. The device of claim 1, wherein the top cover is transparent.

19. The device of claim 1, wherein the shell comprises a lifting lug.

20. The device of claim 1, wherein a width of the inner chamber is equal to or greater than a maximum diameter of the bullets, and a shape of a cross-section of a bottom of the inner chamber is adapted to fit a shape of heads of the bullets.

* * * * *